US005120916A

United States Patent [19]

Horinouchi et al.

[11] Patent Number: 5,120,916

[45] Date of Patent: Jun. 9, 1992

[54] HIGH-FREQUENCY HEATING APPARATUS ALLOWING CONTINUOUS DRIVE OF HIGH FREQUENCY GENERATOR AT MAXIMUM HIGH FREQUENCY OUTPUT WITHIN LIMITED TIME

[75] Inventors: Atsushi Horinouchi; Tetsuzo Hotta; Masanori Yamamoto, all of Shiga, Japan

[73] Assignee: Sanyo Electric Co., Ltd., Osaka, Japan

[21] Appl. No.: 560,155

[22] Filed: Jul. 31, 1990

[30] Foreign Application Priority Data

Aug. 10, 1989 [JP] Japan ..... 1-208121
Jan. 10, 1990 [JP] Japan ..... 2-3255

[51] Int. Cl.[5] ..... H05B 6/68
[52] U.S. Cl. ..... 219/10.55 B; 219/10.55 R
[58] Field of Search ..... 219/10.55 R, 10.55 B, 219/10.55 E, 400; 126/21 A, 21 R; 361/384, 381

[56] References Cited

U.S. PATENT DOCUMENTS 4,236,055 11/1980 Kaminaka ..... 219/10.55 B
4,250,370 2/1981 Sasaki et al. ..... 219/10.55 B
4,332,992 6/1982 Larsen et al. ..... 219/10.55 R
4,506,127 3/1985 Satoh ..... 219/10.55 B
4,517,430 5/1985 Slottag ..... 219/10.55 B
4,864,088 9/1989 Hiejima et al. ..... 219/10.55 B

FOREIGN PATENT DOCUMENTS 55-50504 11/1980 Japan .

*Primary Examiner*—Philip H. Leung
*Attorney, Agent, or Firm*—Darby & Darby

[57] ABSTRACT

A microwave oven comprises a high frequency generator which is formed by a magnetron 5, a high-voltage transformer 6 and a high-voltage capacitor 7, and a cooling device 8 for cooling these components. The heating power of the high frequency generator is reinforced as compared with the cooling power of the cooling device, and there is such a possibility that the magnetron and the like are subjected to abnormal temperature rise if the high frequency generator is continuously driven at the maximum high frequency output. Therefore, if the user sets a heating time for quick heating at the maximum high frequency output in excess of a prescribed maximum allowable heating time of five minutes, driving of the magnetron is inhibited. If quick heating is repetitively performed, the prescribed maximum allowable heating time is corrected in time relation with preceding heating.

15 Claims, 7 Drawing Sheets

HIGH-FREQUENCY HEATING APPARATUS ALLOWING CONTINUOUS DRIVE OF HIGH FREQUENCY GENERATOR AT MAXIMUM HIGH FREQUENCY OUTPUT WITHIN LIMITED TIME

BACKGROUND OF THE INVENTION

1. Field of the Invention

The present invention relates to a high-frequency heating apparatus such as a microwave oven, and more particularly, it relates to a high-frequency heating apparatus which allows continuous drive of a high frequency generator at the maximum high frequency output only under a predetermined time condition.

2. Description of the Background Art

In a conventional microwave oven, a magnetron serving as a high frequency generator is driven by high voltage power which is supplied through a high-voltage transformer and a high-voltage capacitor having prescribed rated values, or the like. The magnetron is cooled by a cooling device, which is formed by a fan or the like, while the same is driven by the high voltage power. Therefore, even if the magnetron is continuously driven for a long time for heating food etc. at the maximum high frequency output, the magnetron is effectively cooled by the cooling device and prevented from abnormal temperature rise. Such a conventional microwave oven is disclosed in Japanese Utility Model Publication No. 55-50504, for example.

In order to improve the performance of such a microwave oven for reducing its heating time, on the other hand, the maximum high frequency output itself may be increased. To this end, the rated value (capacitance value) of the high-voltage capacitor for supplying high tension power to the magnetron may be increased. When the high frequency output itself is thus increased, the cooling power of the cooling device must be improved since the heating value of the magnetron is also increased.

In order to improve the cooling power, however, it is indispensable to increase the size of the cooling device itself. Thus, the microwave oven is entirely increased in size and cost.

SUMMARY OF THE INVENTION

Accordingly, an object of the present invention is to provide a high-frequency heating apparatus of high performance which can reduce its heating time with no increase in cost.

Another object of the present invention is to provide a high-frequency heating apparatus which can increase the maximum high frequency output with no necessity for increasing the size of a cooling device.

Still another object of the present invention is to provide a high-frequency heating apparatus, which can prevent a high frequency generator from abnormal temperature rise under the maximum high frequency output with no necessity for increasing the size of a cooling device.

Briefly stated, the inventive high-frequency heating apparatus is adapted to inhibit driving of a high frequency generator in a drive mode at the maximum high frequency output when the drive mode is set in excess of a prescribed time to cause abnormal temperature rise of the high frequency generator by continuous drive.

In accordance with another aspect of the present invention, the aforementioned prescribed time is corrected if the drive mode at the maximum high frequency output is carried out after execution of an arbitrary drive mode.

Thus, a principal advantage of the present invention is that the maximum high frequency output of the high frequency generator can be increased by increasing the rated value of a high-voltage capacitor, thereby reducing the heating time of the high-frequency heating apparatus.

Another advantage of the present invention is that the high frequency generator can be prevented from abnormal temperature rise without improving the cooling power of the cooling device since the apparatus is inhibited from continuous drive exceeding a prescribed time in the drive mode at the maximum high frequency output.

These and other objects, features, aspects and advantages of the present invention will become more apparent from the following detailed description of the present invention when taken in conjunction with the accompanying drawings.

DESCRIPTION OF THE PREFERRED EMBODIMENTS

The structure of a microwave oven according to a first embodiment of the present invention is now schematically described with reference to FIGS. 1 and 2.

Figure 1:
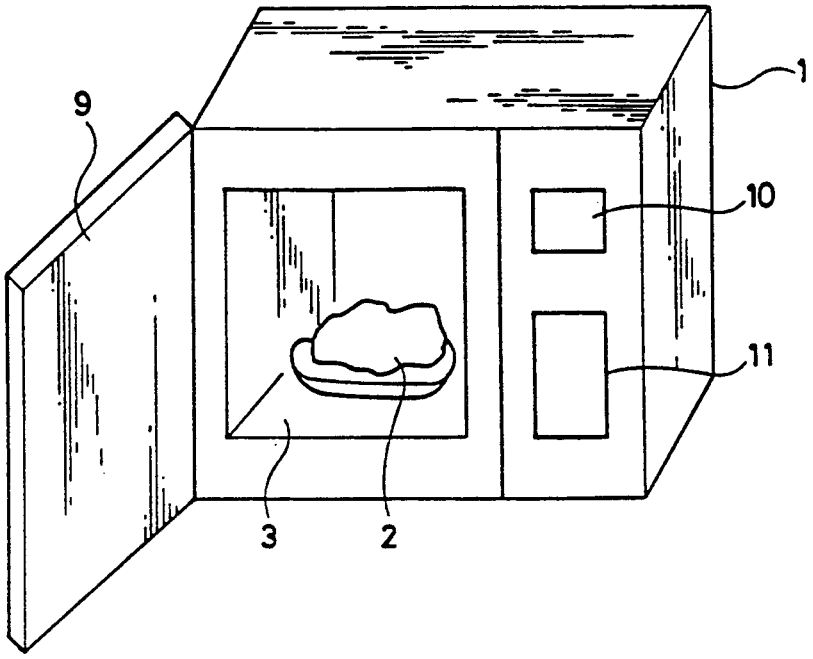
FIG. 1 is a perspective view showing the appearance of a microwave oven according to a first embodiment of the present invention.
Figure 2:
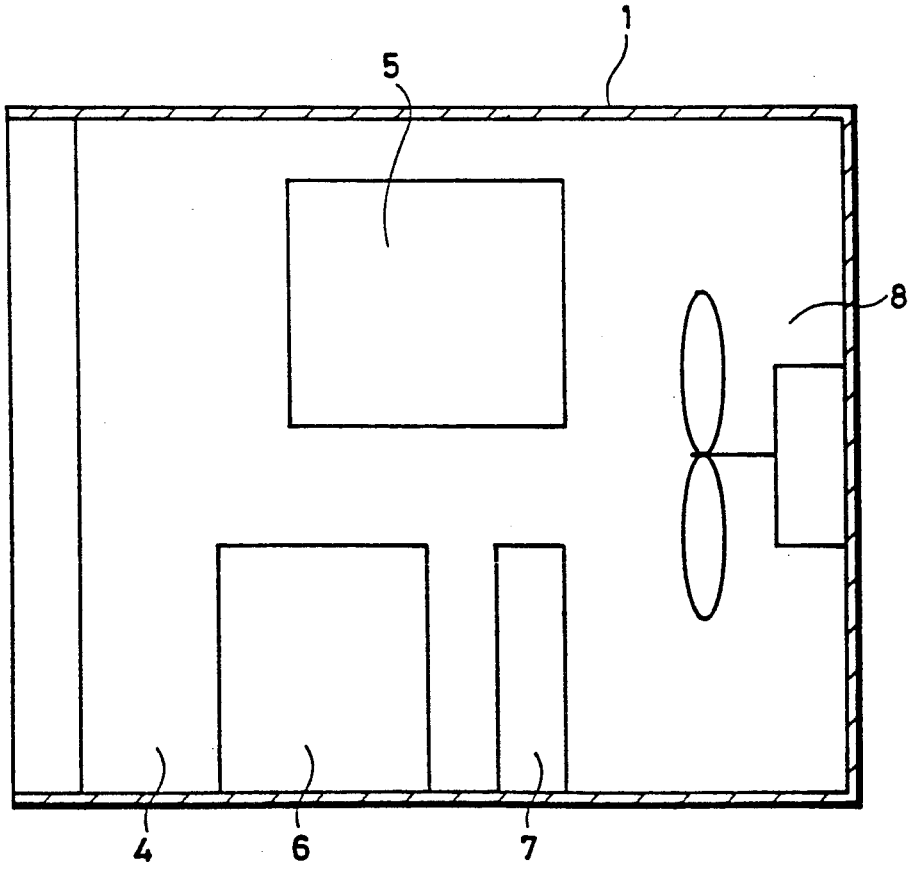
FIG. 2 is a right side sectional view of the microwave oven shown in FIG. 1.

Referring to FIGS. 1 and 2, a body 1 of the microwave oven is provided therein with a heating chamber 3 for receiving food 2, which is the object of heating, and an electric chamber 4. As shown in FIG. 2, the electric chamber 4 is provided therein with a high frequency generator, i.e., a magnetron 5, which supplies high-frequency waves into the heating chamber 3 for heating the food 2, a high-voltage transformer 6 and a high-voltage capacitor 7 for supplying high tension power the magnetron 5, and a cooling device, 8, which is a fan for cooling the ,magnetron 5, the high-voltage transformer 6 and the high-voltage capacitor 7.

Figure 3:
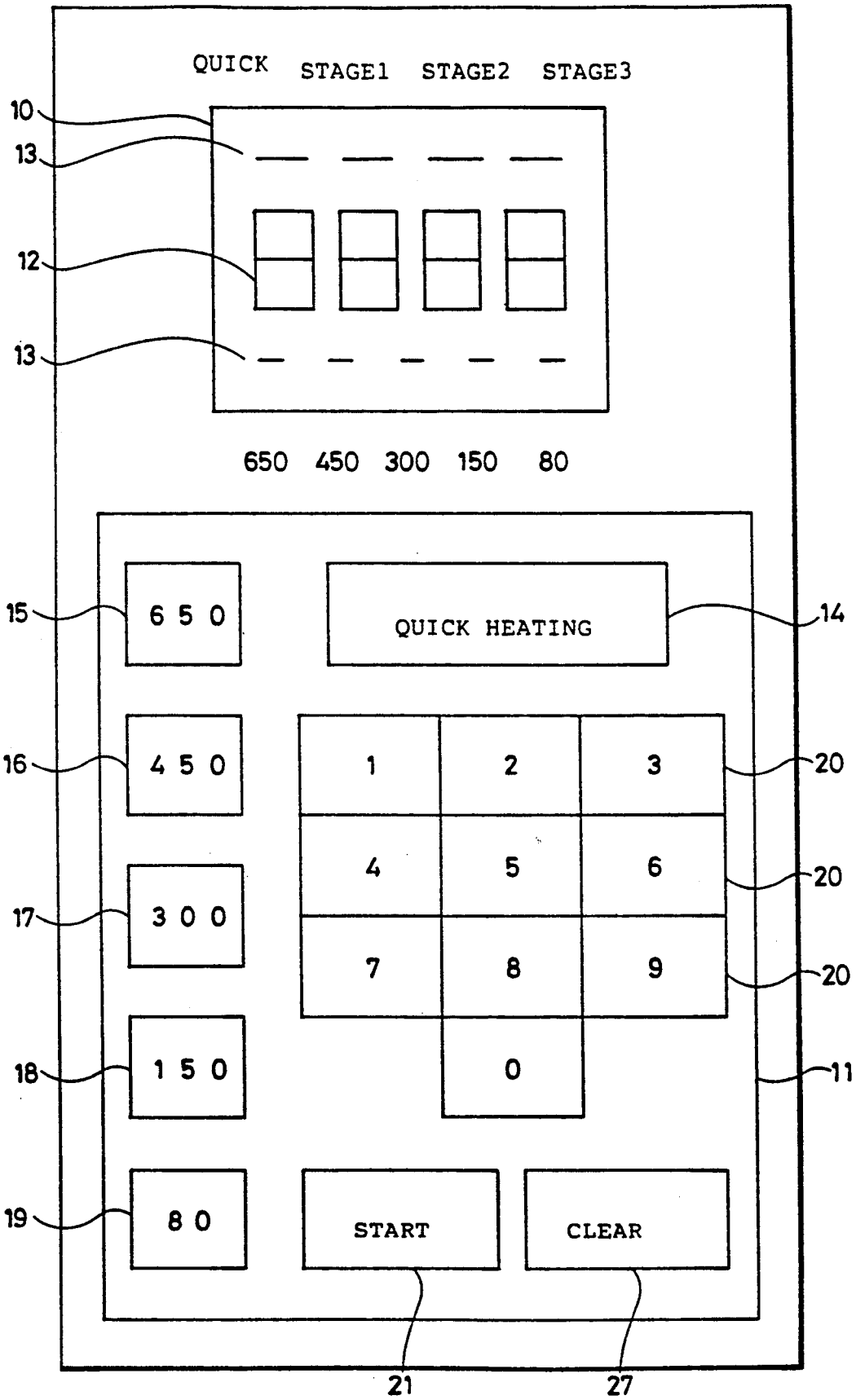
FIG. 3 is a front elevational view showing an essential part of the microwave oven shown in FIG. 1.

On the other hand, a door 9 for opening/closing an opening at the front surface of the heating chamber 3, an indicator 10 and a keyboard 11 are provided on the front surface of the body 1 of the microwave oven, as shown in FIG. 1. FIG. 3 is a front elevational view showing an essential part of the microwave oven, for illustrating the indicator 10 and the keyboard 11 in more detail. The indicator 10 has a digital display part 12 for displaying a heating time, and a drive mode display part 13 for displaying a drive mode of the magnetron 5. On the other hand, the keyboard 11 includes a quick heating key 14, a 650 W key 15, a 450 W key 16, a 300 W key 17, a 150 W key 18 and an 80 W key 19 for setting desired drive modes, i.e., high frequency outputs, a plurality of numeric keys 20 designating numerals of 0 to 9 for setting, desired heating times, a start key 21 for initiating starting of heating, and a clear key 27 for erasing information such as set drive modes, heating times and the like.

Figure 4:
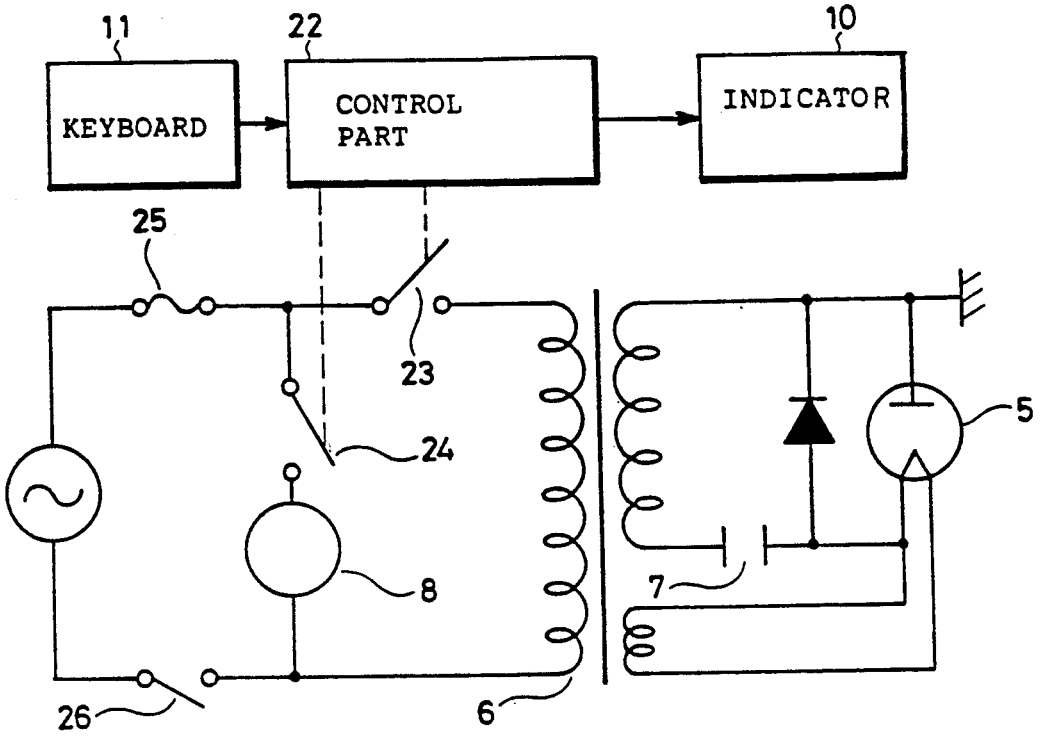
FIG. 4 is a circuit diagram schematically showing a circuit part of the microwave oven according to the first embodiment of the present invention.

FIG. 4 is a circuit diagram showing an electric circuit part of the microwave oven shown in FIGS. 1 to 3. Referring to FIG. 4, the structure of the electric circuit part is now described. This microwave oven comprises a control part 22, which is formed by a microcomputer for controlling operations of the respective parts of the microwave oven. The control part 22 performs control for driving indication on the indicator 10 as well as on-off control for switches 23 and 24 on the basis of information set by means of the keyboard 11 shown in FIG. 3. As hereinafter described, the switch 23 is turned on in heating, so that a commercial power, source applies commercial power to the high-voltage transformer 6 through a power fuse 25 and a door switch 26 which is turned on when the door 9 is closed. In response to this, the high-voltage transformer 6 and the high-voltage capacitor 7 apply high tension power to the magnetron 5, which in turn supplies high frequency waves into the heating chamber 3, thereby heating the food 2.

In such a heating operation, further, the switch 24 is also turned on as hereinafter described, so that the commercial power source also applies commercial power to the cooling device 8 through the power fuse 25 and the door switch 26. Consequently, the cooling device 8 is driven to cool the magnetron 5, the high-voltage transformer 6 and the high-voltage capacitor 7.

Figure 8:
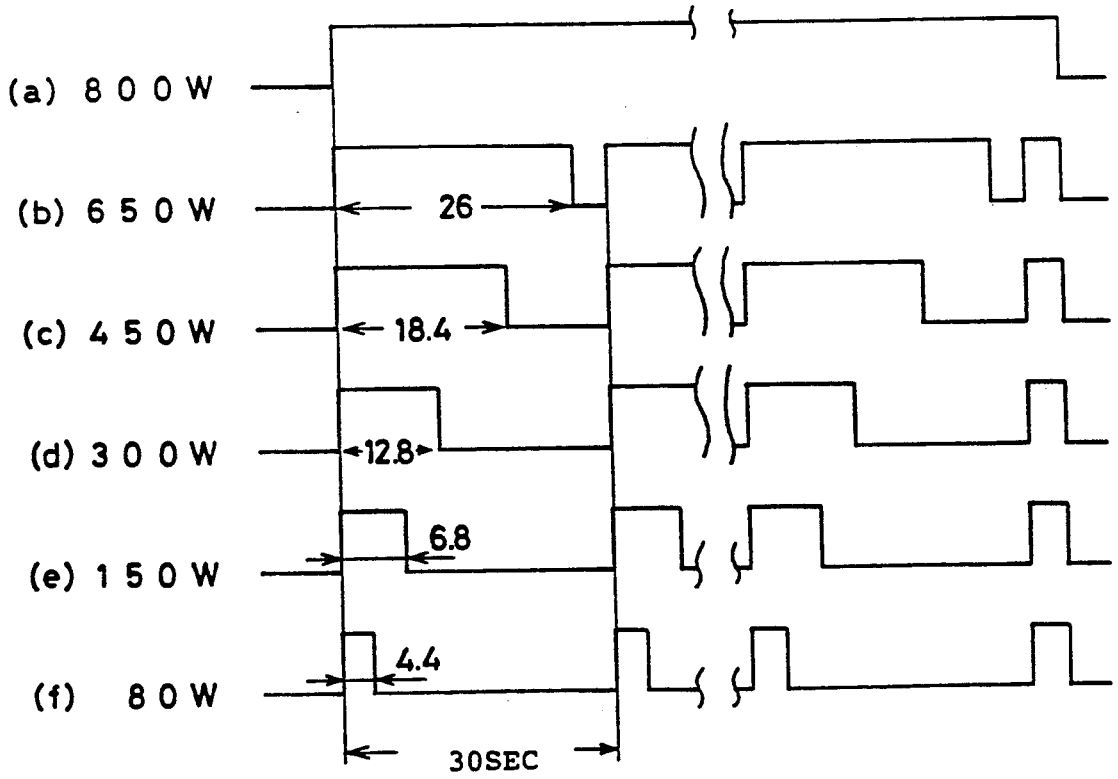
FIG. 8 is a timing chart for illustrating the operations of the microwave oven according to the first embodiment of the present invention.
Figure 5:
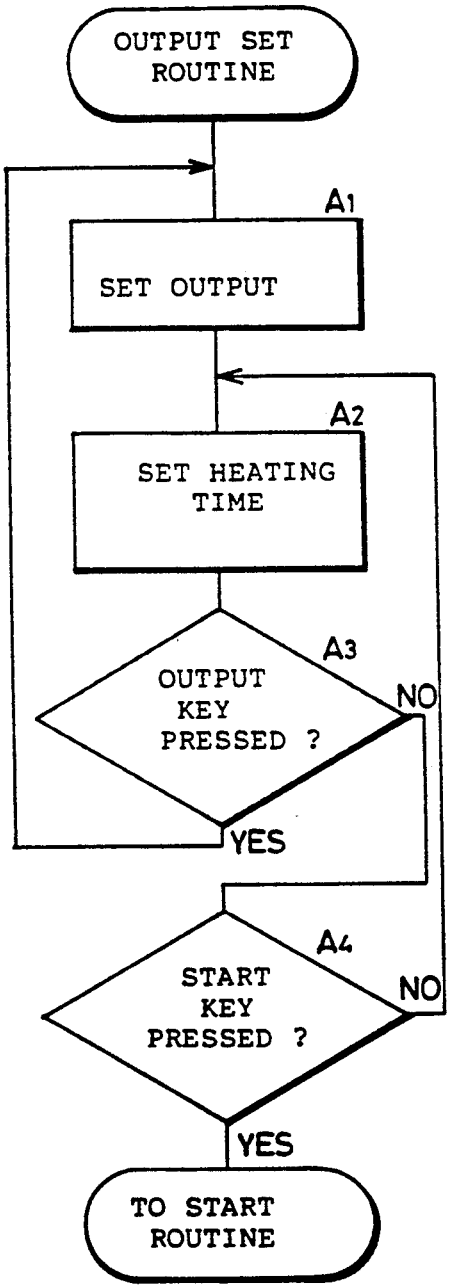
FIGS. 5 to 7 are flow charts for illustrating the operations of the microwave oven according to the first embodiment of the present invention.
Figure 6:
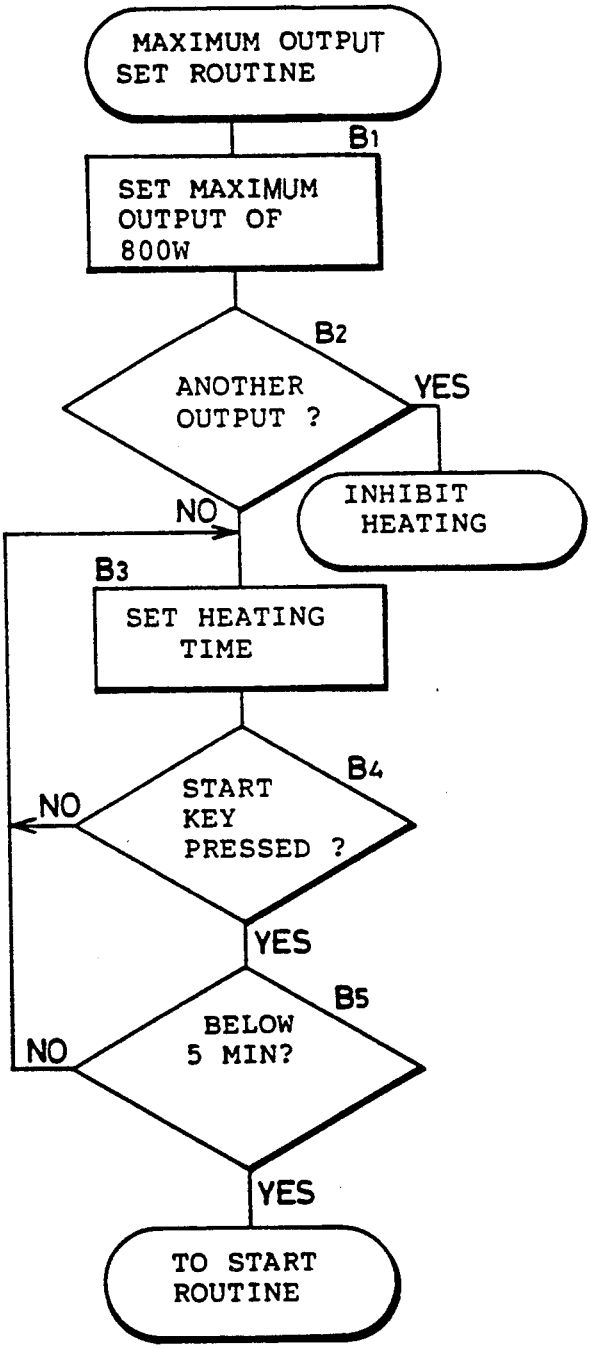
Figure 7:
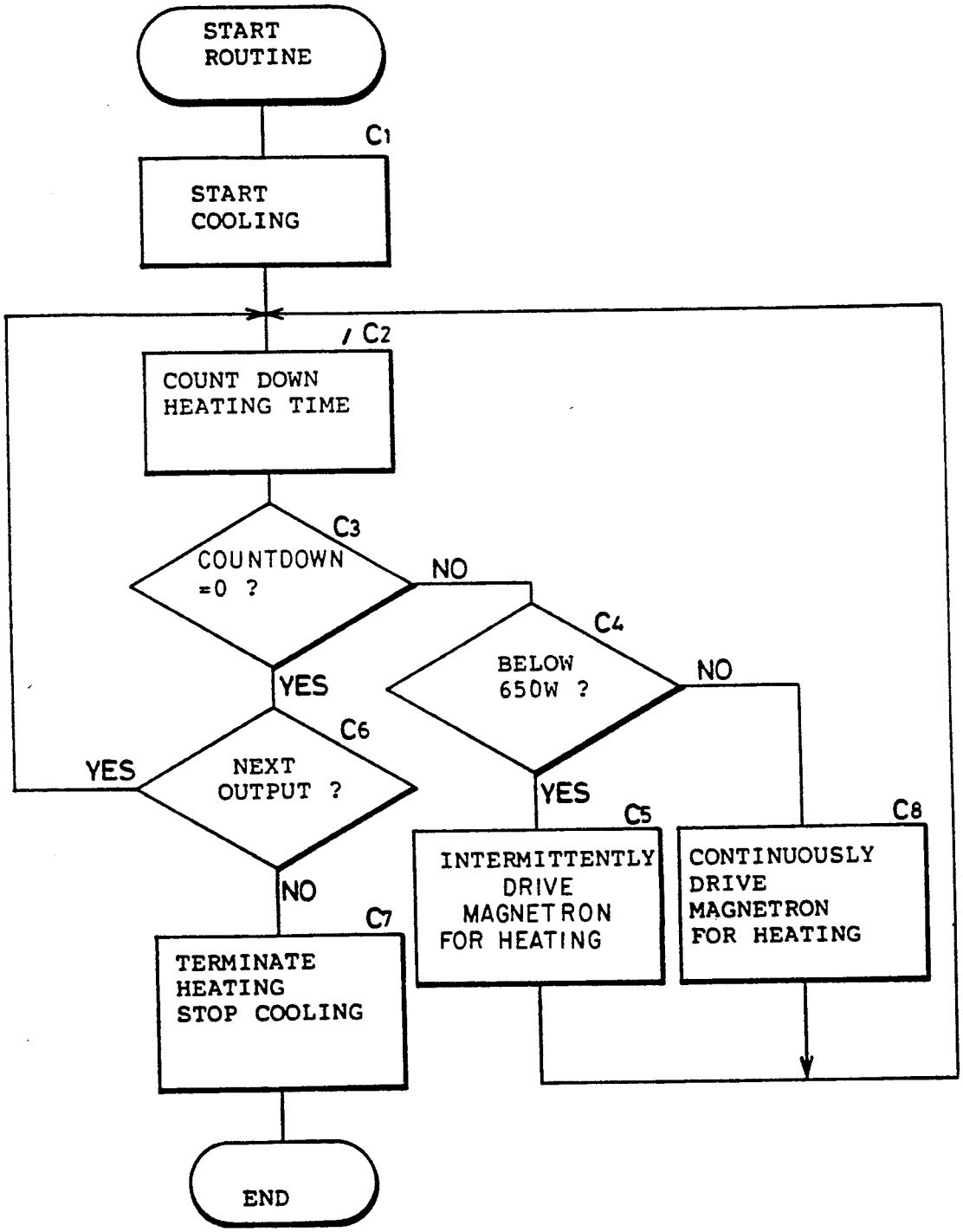

FIGS. 5, 6 and 7 are flow charts showing operation programs set in the control part 22, and FIG. 8 is a timing chart for illustrating the operations of the microwave oven according to the first embodiment of the present invention. Referring to FIGS. 5 to 8, the operations of the microwave oven according to the first embodiment of the present invention are now described.

In order to heat the food 2 for five minutes in a drive mode with a high frequency output of 450 W as a first stage of a cooking operation and then to heat the food 2 for 15 minutes in a drive mode with a high frequency output of 300 W as a second stage, the user presses the keys of the keyboard 11 in the following order, to set the drive modes and the heating times: 450 W→5→0→0→300 W→1→5→0→0

In more concrete terms, the 450 W key 16 is first pressed so that an output set routine is executed along the operation program shown in FIG. 5. This routine is also executed when any one of the 650 W key 15, the 300 W key 17, the 150 W key 18 and the 80 W key 19 is first pressed in place of the 450 W key 16.

In response to the manipulation of the 450 W key 16, the drive mode with the high frequency output of 450 W is set in the control part 22 at a step A1 in FIG. 5. Then, steps A2, A3 and A4 are carried out in a cyclic manner. At the step A2, a heating time is set by means of the numeric keys 20 of the keyboard 11. Then, a determination is made at the step A3 as to whether or not any key has been pressed for setting a further high frequency output, i.e., a further drive mode. Then, a determination is made at the step A4 as to whether or not the start key 21 has been pressed.

Thus, when the numeric keys 20 are pressed in the above order of 5→0→0 after the high frequency output of 450 W is set at the step A1, the heating time of five minutes for the drive mode with the high frequency output of 450 W is set in the control part 22 at the step A2. Then the 300 W key 17 is pressed so that it is determined at the step A3 that key manipulation has been performed for setting a further drive mode, and the program returns to the step A1 so that the drive mode with the high frequency output of 300 W is set in the control part 22. Thereafter the steps A2, A3 and A4 are carried out in a cyclic manner. Namely, the numeric keys 20 are pressed in the aforementioned order of 1→5→0→0, so that the heating time of 15 minutes for the drive mode with the high frequency output of 300 W is set in the control part 22 at the step A2. Then the start key 21 is pressed to heat the food 2, whereby the program advances from the step A3 to the step A4, and it is determined that the start key 21 has been pressed. Thus, the output set routine shown in FIG. 5 is completed and thereafter a routine of the operation program shown in FIG. 7 is executed.

Referring to FIG. 7, the switch 24 shown in FIG. 4 is turned on at a step C1, whereby the cooling device 8 is driven to cool the magnetron 5, the high-voltage transformer 6 and the high-voltage capacitor 7 as hereinabove described. Then, at a step C2, started is a countdown for the heating time of five minutes for the high frequency output of 450 W for the drive mode of the first stage set in the aforementioned output set routine. Then, a determination is made at a step C3 as to whether or not the countdown for the heating time has reached zero. If the countdown has not yet reached zero, the program advances to a step C4, to determine whether or not the high frequency output of the set drive mode is below 650 W. Since the drive mode is set at 450 W, i.e., below 650 W, the program advances to a step C5. At the step C5, the switch 23 is on-off controlled in a cycle of 30 seconds to be turned on by 18.4 seconds in each cycle, as shown at (c) in FIG. 8, in response to the drive mode set at the high frequency output of 450 W. Thus, the magnetron 5 is intermittently driven by the on-off control of the switch 23, thereby heating the food 2 at the high frequency output of 450 W. If the drive mode is set at the high frequency output of 650 W, the switch 23 is on-off controlled at the step C5 in a cycle of 30 seconds to be turned on by 26 seconds in each cycle, as shown at (b) in FIG. 8. Similarly, when the drive mode is set at the high frequency output of 300 W, 150 W or 80 W, the switch 23 is on-off controlled in a cycle of 30 seconds to be turned on by 12.8 seconds, 6.8 seconds or 4.4 seconds in each cycle as shown at (d), (e) or (f) in FIG. 8.

Thereafter the above steps C2 to C5 are carried out in a cyclic manner. If it is determined at the step C3 that the countdown for the heating time in the drive mode with the high frequency output of 450 W has reached zero, the program advances to a step C6, to determine whether or not a drive mode for the next stage has been set. Since the high frequency output of 300 W has been set for the drive mode of the second stage, the steps C2 to C5 are again carried out in a cyclic manner. In such cyclic execution of the steps, a countdown for the heating time of 15 minutes for the high frequency output of 300 W is started at the step C2. Then, a determination is made at the step C3 as to whether or not the countdown for the above heating time has reached zero. If the countdown has not yet reached zero, the program advances to the step C4, to determine whether or not the set high frequency output is below 650 W. Since the high frequency output is set at 300 W, i.e., below 650 W, the program advances to the step C5, at which the switch 23 is on-off controlled in a cycle of 30 seconds to be turned on by 12.8 seconds in each cycle as shown at (d) in FIG. 8, in response to the high frequency output of 300 W for the set drive mode. Thus, the magnetron 5 is intermittently driven in response to the on-off control of the switch 23, thereby heating the food 2 at the high-frequency output of 300 W. After the steps C2 to C5 are thus carried out in a cyclic manner, it is determined at the step C3 that the countdown for the heating time for the high frequency output of 300 W has reached zero, and the program advances to the step C6. Since no further drive mode, i.e., no further high frequency output is set in the first embodiment, the program advances to a step C7, to stop the on-off control for the switch 23 and terminate the aforementioned operation for heating the magnetron 5. Further, the switch 24 is simultaneously turned off at the step C7, to stop the operation for cooling the magnetron 5 and the like.

Thus completed is the cooking operation including the first stage of heating the food 2 for five minutes in the drive mode with the high frequency output of 450 W and the second stage of heating the food 2 for 15 minutes in the drive mode with the high frequency output of 300 W. During such heating operations, the cooling device 8 is continuously driven to cool the magnetron 5, the high-voltage transformer 6 and the high-voltage capacitor 7, thereby preventing these components from abnormal temperature rise.

In order to perform quick heating at the maximum high frequency output for three minutes, the user presses the keys of the keyboard 11 in the following order, to set the drive mode and the heating time:

quick heating→3→0→0

In more concrete terms, the quick heating key 14 is first pressed to execute the maximum output set routine according to the operation program shown in FIG. 6.

In response to such manipulation of the quick heating key 14, a drive mode with the maximum high frequency output of 800 W is set in the control part 22 at a step B1 in FIG. 6. Then, a determination is made at a step B2 as to whether or not another drive mode with another high frequency output has been set in advance of the drive mode with the maximum high frequency output of 800 W. Since no other drive mode has been set in the first embodiment, steps B3 and B4 are carried out in a cyclic manner. At the step B3, the numeric keys 20 of the keyboard 11 are pressed to set the heating time. Then, a determination is made at the step B4 as to whether or not the start key 21 is pressed. Thus, after the maximum high frequency output of 800 W is set at the step B1, the numeric keys 20 are pressed in the aforementioned order of 3→0→0 so that the heating time of three minutes for the maximum high frequency output of 800 W is set in the control part 22 at the step B3.

Then the start key 21 is pressed in order to execute heating, whereby the program advances from the step B4 to a step B5, to determine whether or not the heating time for the quick heating set in the aforementioned manner is below five minutes. Since the heating time is set at three minutes, i.e., below five minutes as described above, the program advances to the aforementioned routine shown in FIG. 7, to start driving of the cooling device 8 at the step C1 and carry out the steps C2, C3 and C4. At the step C4 in FIG. 7, it is determined that the output is set at the maximum high frequency output of 800 W in excess of 650 W, whereby the program advances to a step C8. At the step C8, the switch 23 is continuously turned on as shown at (a) in FIG. 8, whereby the magnetron 5 is continuously driven to heat the food 2 at the maximum high frequency output of 800 W.

Thereafter the steps C1 to C4 and C8 are carried out in a cyclic manner. Such cyclic execution is terminated when it is determined at the step C3 that the countdown for the heating time for the maximum high frequency output has reached zero. Since no further drive mode is set in succession, the program advances from the step C6 to the step C7 to stop the continuous on-control for the switch 23 and terminate the heating control for the magnetron 5. The switch 24 is simultaneously turned off at the step C7, to stop the cooling operation for the magnetron 5 and the like.

Thus, the quick heating operation for heating the food 2 in the drive mode with the maximum high frequency output of 800 W is completed. During such a heating operation, the cooling device 8 is continuously driven to cool the magnetron 5, the high-voltage transformer 6 and the high-voltage capacitor 7, thereby preventing these components from abnormal temperature rise.

If the heating time for the maximum high frequency output of 800 W for quick heating is erroneously set in excess of the aforementioned prescribed time of five minutes, this error is recognized at the step B5 in FIG. 6 and the program returns to the step B3. Therefore, even if the start key 21 has been pressed at the step B4, the program will not advance to the routine of FIG. 7 and no quick heating operation is started. The quick heating operation is sufficiently achieved within about five minutes in practice.

In the microwave oven according to the first embodiment of the present invention, the high-voltage capacitor 7 has a higher rated value (capacitance value) than a general one, and hence the maximum high frequency output for continuously driving the magnetron 5 is increased to 800 W. Thus, the heating time is reduced by the aforementioned quick heating. With such increase of the maximum high frequency output, on the other hand, the heating values of the magnetron 5, the high-voltage transformer 6 and the high-voltage capacitor 7 are also increased. If the cooling power of the cooling device 8 remains at a general value, therefore, the magnetron 5 and the like are subjected to abnormal temperature rise due to continuous driving of the magnetron 5.

According to the first embodiment, however, the heating time of five minutes is previously set for the maximum high frequency output of 800 W for such quick heating and starting of heating is inhibited if the heating time is erroneously set in excess of five minutes as shown at the step B5 of FIG. 6. Thus, it is possible to prevent the magnetron 5 and the like from abnormal temperature rise without improving the cooling power of the cooling device 8. According to the first embodiment of the present invention, therefore, the heating time of the microwave oven can be reduced without increasing the size of and the cost for the cooling device. Thus, the step B5 in the routine shown in FIG. 6 corresponds to inhibition means of the present invention.

At the step B2 of the routine shown in FIG. 6, the program is inhibited from setting another drive mode with another high frequency output in advance of the drive mode with the maximum high frequency output of 800 W and continuously performing heating operations with another high frequency output and the maximum high frequency output. If the food 2 is heated in such a combination of the drive modes, the magnetron 5 and the like may be subjected to abnormal temperature rise.

Further, the program is also inhibited from setting another drive mode with another high frequency output following the drive mode with the maximum high frequency output of 800 W and continuously performing heating operations with the maximum high frequency output and another high frequency output. In the program shown in FIG. 6, no step is provided for setting another high frequency output after manipulation of the quick heating key 14, and hence it is impossible to set the aforementioned drive mode, which may cause abnormal temperature rise of the magnetron 5 and the like.

If the heating time is set at, e.g., six minutes in excess of the prescribed time of five minutes, the heating operation itself may not be completely inhibited. dissimilarly to the above embodiment. Alternatively, a quick heating operation may be performed for five minutes within the set time of six minutes, while stopping heating for the remaining one minute.

As to the quick heating operation allowed within the limited time of five minutes according to the aforementioned embodiment, abnormal temperature rise may be caused in the magnetron, which has a high initial temperature, if quick heating within five minutes is continuously set and executed immediately upon completion of heating in some drive mode. If quick heating at the maximum high frequency output is repeatedly set and executed in a short cycle, for example, it is necessary to protect the magnetron and the like against abnormal temperature rise without improving the cooling power of the cooling device. According to a second embodiment of the present invention, the magnetron is prevented from such abnormal temperature rise in the following manner:

When quick heating at the maximum high frequency output is set immediately after driving of the magnetron in some drive mode is terminated, the initial temperature of the magnetron is increased in proportion to the heating time in the preceding drive mode and in inverse proportion to a pause upon completion of the preceding heating. The second embodiment of the present invention is adapted to correct the aforementioned allowable time (five minutes) for quick heating on the basis of the heating time for the preceding heating operation and the pause upon completion of the preceding heating and to inhibit heating if quick heating at the maximum high frequency output is set in excess of the corrected allowable time.

Figure 9:
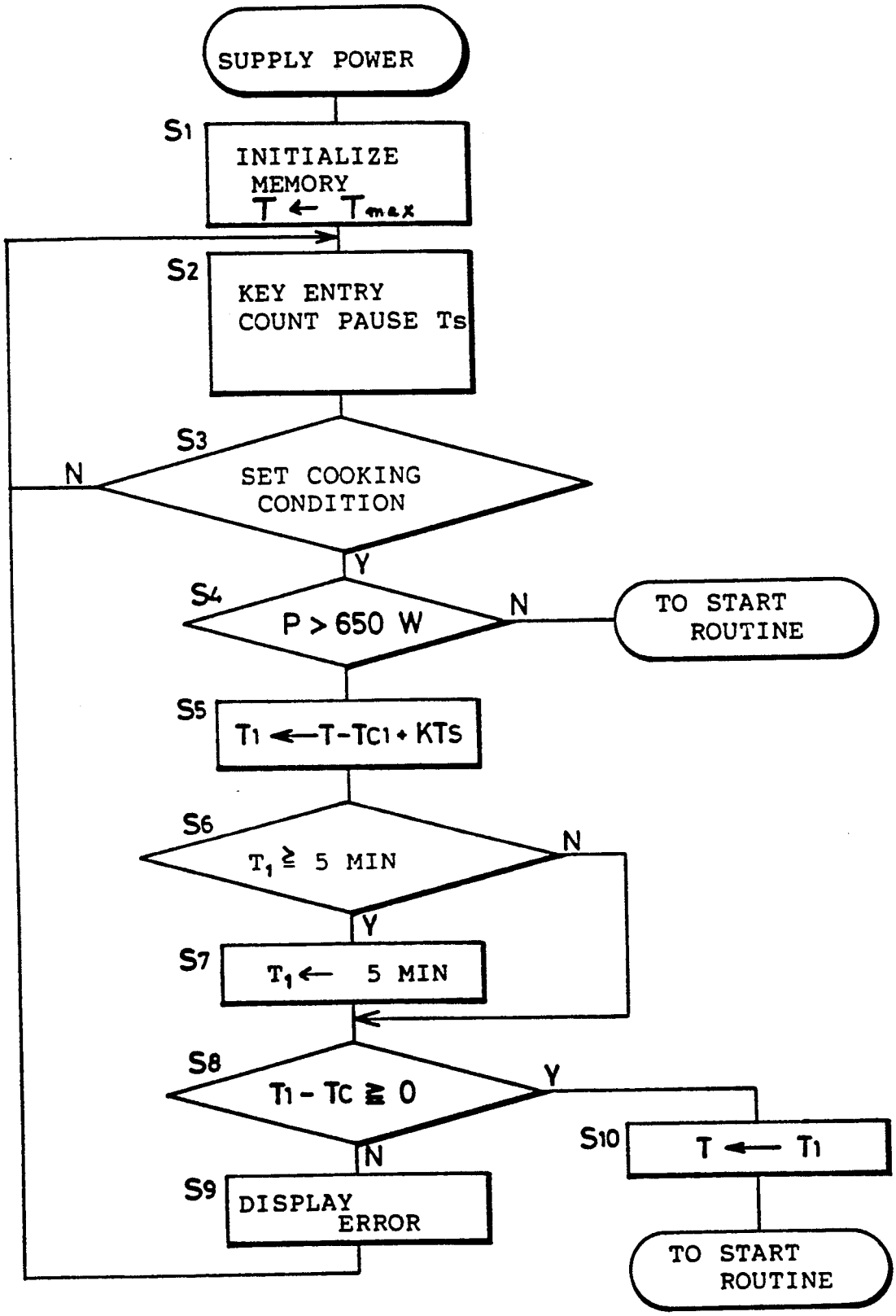
FIGS. 9 and 10 are flow charts for illustrating the operations of a microwave oven according to a second embodiment of the present invention.
Figure 10:
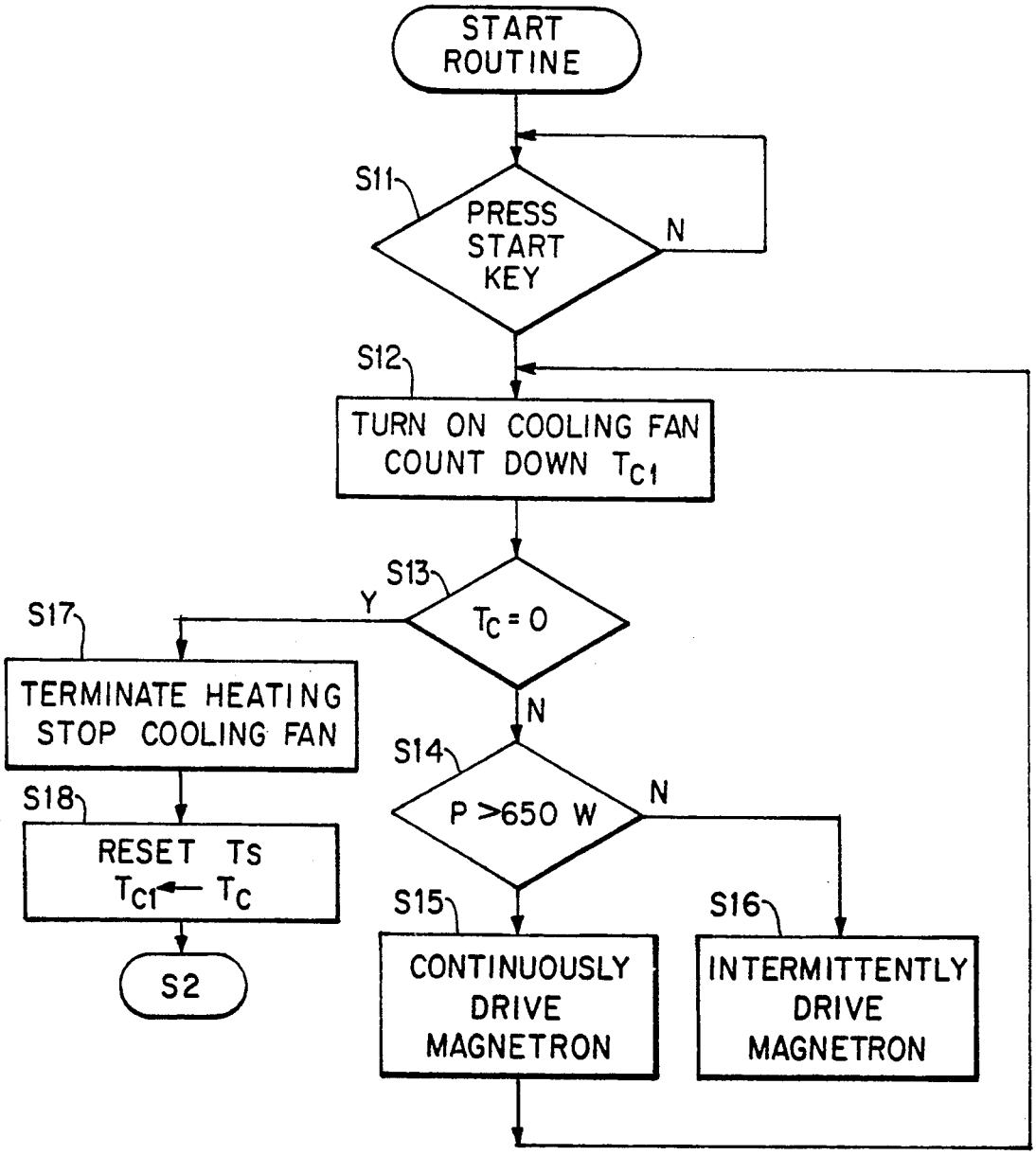

FIGS. 9 and 10 are flow charts showing the operations of the second embodiment of the present invention set in the control part 22.

Referring to FIG. 9, a memory provided in the control part 22 is initialized at a step S1 upon power supply to the microwave oven, and a prescribed (highest) allowable heating time $T_{max}$ (five minutes) is set as an allowable heating time T at the maximum high frequency output. Thereafter operations of steps S2 and S3 are executed in a cyclic manner so that a determination is made at the step S2 as to whether or not the various drive mode set keys 14 to 21 and the numeric keys 20 of the keyboard 11 are pressed, and a pause Ts between completion of preceding heating and setting of a new drive mode or starting of heating is counted. If it is determined at the step S3 that the drive mode and a heating time Tc are completely set through the keyboard 11, the program advances to a step S4, to determine whether the drive mode set in the aforementioned manner is for quick heating with the maximum high frequency output (800 W) or heating with a high frequency output of below 650 W. If a high frequency output of not more than 650 W has been set, the program advances to a start routine shown in FIG. 10. If quick heating with the maximum high frequency output of 800 W has been set, on the other hand, steps S5 to S8 shown in FIG. 9 are carried out.

At the step S5, a heating time $T_1 = T - T_{cl} + kTs$, which is allowed for this quick heating, is evaluated. Namely, if quick heating at the maximum high frequency output is repeated, a time $T_{cl}$ actually required for preceding heating is subtracted from an allowable heating time T evaluated for the preceding quick heating, and a value kTs obtained by multiplying the pause Ts evaluated at the step S2 by a recovery coefficient k is added to the result, thereby evaluating the new allowable heating time $T_1$. When it is determined at the step S6 that the evaluated allowable heating time $T_1$ exceeds the aforementioned maximum allowable heating time $T_{max}$ (five minutes), the value $T_1$ evaluated in the aforementioned manner is set at the maximum allowable heating time, i.e., five minutes, at the step S7.

If the preceding drive mode is not for quick heating with the maximum high frequency output of 800 W, it is preferable to correct the preceding heating time $T_{cl}$ in response to the high frequency output of the preceding drive mode, when the allowable heating time $T_1$ is evaluated at the step S5.

Then, a determination is made at a step S8 as to whether or not the currently set heating time Tc exceeds the allowable heating time $T_1$ evaluated in the aforementioned manner. If the determination is of yes, an error is displayed at a step S9, and the program returns to the step S2. Namely, the program cannot advance to a start routine and heating is inhibited as the result. If it is determined at the step S8 that the set time Tc is within the allowable heating time $T_1$, on the other hand, the program advances to a step S10 and the allowable heating time $T_1$ is stored in the memory of the control part 22, to execute the start routine shown in FIG. 10.

At a step S11 in FIG. 10, a determination is made as to whether or not the start key 21 has been pressed. If it is determined that the start key 21 has been pressed in order to heat the food 2, steps S12 to S16 are carried out in a cyclic manner, to perform heating control.

At the step S12, the switch 24 shown in FIG. 4 is turned on to start driving of the cooling device 8, thereby cooling the magnetron 5 and the like. A countdown for the set heating time Tc is also started. Then, at the step S13, a determination is made as to whether or not the countdown for the heating time Tc has reached zero. If the countdown has not yet reached zero, the program advances to the step S14, to determine whether or not the set high frequency output is in excess of 650 W. If the program has advanced to this routine from the step S4 shown in FIG. 9, the set output is not more than 650 W and hence the program advances from the step S14 to the step S16, to intermittently drive the magnetron 5 in a cycle of 30 seconds in any one of the drive modes shown at (b) to (f) in FIG. 8. If the program has advanced to this routine from the step S10 shown in FIG. 9, on the other hand, the set output is 800 W in excess of 650 W, and hence the program advances from the step S14 to the step S15, to continuously drive the magnetron 5 in the drive mode shown at (a) in FIG. 8.

When it is determined at the step S13 that the countdown for the set heating time has reached zero, the program advances to a step S17 to stop on-off control for the switch 23, thereby terminating the heating operation of the magnetron 5. The switch 24 is simultaneously turned off at the step S17, to stop the cooling operation for the magnetron 5 and the like. At a step S18, a counter for the pause Ts is reset and the current heating time is stored in the memory of the control part 22, and the program advances to the standby states of the steps S2 and S3 in FIG. 9. Then, the pause Ts is counted in preparation for subsequent heating.

According to the second embodiment of the present invention, as hereinabove described, the allowable heating time is corrected on the basis of the drive mode for the preceding heating operation and the pause upon termination of the preceding heating operation when heating is repeated at the maximum high frequency output, whereby the magnetron can be prevented from abnormal temperature rise also in the case of repetitive quick heating.

Although the magnetron is continuously driven for the drive mode with the maximum high frequency output and intermittently driven for other drive modes in each of the aforementioned embodiments, all drive modes can be implemented by continuously driving the magnetron, by providing a plurality of high-voltage capacitors 7.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A high-frequency heating apparatus comprising:

a heating chamber for receiving an object to be heated;

high frequency generator means for supplying high frequency waves into said heating chamber with a variable high frequency output, said high frequency generator means having a property of causing abnormal temperature rise upon driving at the maximum high frequency output in excess of a prescribed time;

cooling means for cooling said high frequency generator means while said high frequency means supplies said high frequency waves;

means for setting a drive mode of said high frequency generator means;

means for setting a heating time for said drive mode set by said drive mode setting means;

starting means for initiating a starting of driving of said high frequency generator means in said set drive mode; and control means for controlling operations of said cooling means and said high frequency generator means in response to initiation by said starting means on the basis of said drive mode set by said drive mode setting means and said heating time set by said heating time setting means, said control means including means responsive to the drive mode being set by said drive mode setting means for limiting driving of said high frequency generator means at the maximum high frequency output if said heating time set by said heating time setting means is in excess of said prescribed time when said drive mode is at the maximum high frequency output as set by said drive mode setting means.

2. A high-frequency heating apparatus in accordance with claim 1, wherein said driving limiting means includes means for inhibiting starting of driving of said high frequency generator means at the maximum high frequency output when said set heating time is in excess of said prescribed time.

3. A high-frequency heating apparatus in accordance with claim 1, wherein said driving limiting means includes means for inhibiting driving of said high frequency generator means at the maximum high frequency output for a period exceeding said prescribed time if said set heating time is in excess of said prescribed time.

4. A high-frequency heating apparatus in accordance with claim 1, wherein said control means includes means for correcting said prescribed time to a corrected prescribed time when said high frequency generator means is driven at the maximum high frequency output after the same is driven in an arbitrary drive mode.

5. A high-frequency heating apparatus in accordance with claim 4, wherein said correction means corrects said prescribed time on the basis of a time required for driving said high frequency generator means in said arbitrary drive mode.

6. A high-frequency heating apparatus in accordance with claim 4, wherein said correction means corrects said prescribed time on the basis of a time required for driving said high frequency generator means in said arbitrary drive mode and a pause between termination of driving in said arbitrary drive mode and execution of driving at the maximum high frequency output.

7. A high-frequency heating apparatus in accordance with claim 6, furher comprising means for evaluating said corrected prescribed time to provide a result by subtracting said time required for driving said high frequency generator means in said arbitrary drive mode from said corrected prescribed time for driving in said arbitrary drive mode and further adding said pause to the result.

8. A high-frequency heating apparatus in accordance with claim 7 further comprising means for setting said corrected prescribed time at maximum allowable heating time when said evaluated corrected prescribed time exceeds said maximum allowable heating time.

9. A high-frequency heating apparatus in accordance with claim 1, wherein said high frequency generator means includes a magnetron (5), and a high-voltage transformer (6) and a high-voltage capacitor (7) for supplying high voltage power to said magnetron.

10. A high-frequency heating apparatus in accordance with claim 9, further comprising:

means for continuously driving said magnetron to implement said drive mode with the maximum high frequency output, and means for intermittently driving said magnetron to implement other drive modes.

11. A high-frequency heating apparatus in accordance with claim 1, wherein said control means includes:

first switching means (23) for connecting said high frequency generator means to a power source, second switching means (24) for connecting said cooling means to a power source, and a microcomputer (22) for on-off controlling said first and second switching means in response to initiation by said starting means and on the basis of said set drive mode and set heating time.

12. A high-frequency heating apparatus in accordance with claim 1, further comprising display means for displaying an error when said heating time set by said heating time set means exceeds said prescribed time.

13. A high-frequency heating apparatus in accordance with claim 1, wherein said control means includes means for inhibiting setting of said high-frequency generator means to drive at the maximum high-frequency output while said high frequency generator means is driving in a previously set arbitrary drive mode.

14. A high-frequency heating apparatus in accordance with claim 1, wherein said control means includes means for inhibiting setting of said high-frequency generator means to drive at an arbitrary while said high-frequency generator means is driving at the maximum high-frequency output as previously set.

15. A high-frequency heating apparatus in accordance with claim 1, wherein said cooling means is for providing constant cooling power to said high frequency generator means while said high-frequency means supplies said high-frequency waves.

* * * * *